US005549715A

United States Patent [19]

Olip

[11] Patent Number: 5,549,715

[45] Date of Patent: Aug. 27, 1996

[54] METHOD FOR BLEACHING TEXTILE MATERIAL

[75] Inventor: Vinzenz Olip, Villach, Austria

[73] Assignee: Degussa Austria GmbH, Vienna, Austria

[21] Appl. No.: 347,146

[22] Filed: Nov. 22, 1994

[30] Foreign Application Priority Data

Nov. 23, 1993 [AT] Austria ..... 2378/93

[51] Int. Cl.[6] ..... D06L 3/10

[52] U.S. Cl. ..... 8/110; 8/102; 8/107; 252/188.2; 252/188.21; 510/494; 510/303; 510/302; 510/367; 510/370; 510/470

[58] Field of Search ..... 8/101, 102, 110, 8/111, 107, 453, 465; 252/105, 188.2, 188.21, 188.23

[56] References Cited

U.S. PATENT DOCUMENTS

| | | | |
|---|---|---|---|
| 4,240,791 | 12/1980 | Sato et al. | 8/465 |
| 5,246,001 | 12/1993 | Arifoglu | 8/110 |
| 5,366,510 | 11/1994 | Wasinger | 8/110 |

FOREIGN PATENT DOCUMENTS

| | | |
|---|---|---|
| 0175272 | 3/1986 | European Pat. Off. . |
| 2011387 | 10/1970 | Germany . |
| 2165154 | 7/1973 | Germany . |
| 3831098 | 3/1990 | Germany . |
| 3833194 | 4/1990 | Germany . |

OTHER PUBLICATIONS

Derwent Acc. No. 80–24863C, 1980 (Month Unknown).
Derwent Acc. No. 86–268586, 1986 (Month Unknown).
Derwent Acc. No. 89–155166, 1989 (Month Unknown).
Federal Law Gazette No. 612 of Sep. 24, 1992, Limitation of Waste Water Emissions from Textile Finishing and Processing Plants.
Peter M. et al: "Grundlagen der Textilveredelung" [Basics of Textile Finishing], 13th ed., Deutscher Fachverlag, 1989, pp. 80 to 81.

*Primary Examiner*—Prince Willis, Jr.
*Assistant Examiner*—Alan D. Diamond
*Attorney, Agent, or Firm*—Spencer & Frank

[57] ABSTRACT

A method for bleaching textile material, including preparing an aqueous alkaline solution of a bleaching agent composed of formamidine sulfinic acid and at least one carbohydrate having a general total formula $C_nH_{2n}O_n$, the formamidine sulfinic acid and the at least one carbohydrate having a weight ratio with respect to one another which ranges from 80:20 to 99:1; and bleaching textile material composed at least in part of cellulose materials by contacting the textile material with the bleaching agent at a temperature above 50° C. therefor.

14 Claims, No Drawings

METHOD FOR BLEACHING TEXTILE MATERIAL

BACKGROUND OF THE INVENTION

1. Field of the Invention

The present invention relates to a method for bleaching textile pieces with reducing agents, in particular denim pieces or warp bodies comprised of indigo-dyed warp and white shot.

2. Description of the Related Art

Inspired by modern processing technology and driven by the will for stylish textile designs by means of washing, bleaching and dyeing, there has never been a lack of attempts to vary denim pieces. Denim is a weaving technique wherein the warp consists of a yarn dyed with a continuous-indigo-dyed yarn and the shot of a white yarn. Blue denim, a fabric often used for producing blue jeans is a three-leaf warp body (K2s/1) for example, which has a warp which is dyed blue by means of indigo mainly on the fabric surface. The mainly white-dyed shot is visible on the underside of the fabric in contrast thereto.

For this reason, industrial laundries have continuously attempted to perform, by means of outlandish technologies, a discharge in a mechanical (stone-wash) or chemical (snow-wash) manner. A typical method used by industrial laundries for producing stylish jeans pieces by means of the stone-wash method proceeds as follows:

The finished ready-to-wear pieces are turned inside out and pre-washed or desized. The pieces are then removed from the washing machine, turned right side out and are washed with calcareous sandstone (pumice stone) at a ratio of 1:3 (1 kg material:3 kg stone). The material is then removed from the machine, the stones are removed and it is bleached with sodium hypochlorite (depending on the desired shade) (Peter, M.; Ruette, H. K., Grundlagen der Textilveredelung [Basics of Textile Finishing], 13th ed., Deutscher Fachverlag, 1989, pp. 80 to 81).

In the jargon of textile finishing, this type of processing of ready-to-wear goods comes under the term "fully fashioned" finishing.

In accordance with DE-A1-38 33 194, when dyeing textile materials made of cellulose fibers or containing cellulose fibers mixed with synthetic fibers, vat dyestuffs in aqueous alkaline medium in the presence of reducing agents and, if required, further conventional auxiliary agents, are used at temperatures of, for example, 45° to 60° C. Dyeing is subsequently completed in that the textile material is rinsed, oxidized and washed.

The structural principle of indigoid dyestuffs can be generally described by the following formula:

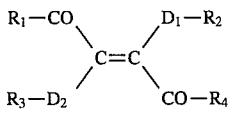

$D_1$=$D_2$=NH=indigoid dyestuff in the narrower sense $D_1$=$D_2$=S=thioindigoid dyestuff $R_1$ to $R_4$=structural elements The installation of these structural elements. R, D and CO in heterocyclic rings results in stable, technically usable dyestuffs, such as the classical indigo, which is registered in the Color Index under the identification C.I. vat blue 1 or C.I. pigment blue 66, and is commercially available.

The numerous representatives of indigoid dyestuffs are being traded as so-called vat dyestuffs, less frequently as pigments. The dyestuffs obtainable by the direct halogenation of indigo have particularly proven themselves, such a C.I. vat blue 41, C.I. vat blue 5, C.I. vat blue 37, C.I. vat blue 35, C.I. vat blue 48 or C.I. acid blue 74. Blue tones with a greenish cast are created if, for example, indigo is chlorinated or if hypochlorite is used for bleaching.

Vat dyestuffs are practically insoluble in water and must be made water-soluble prior to dyeing by reduction in an alkaline solution. The reaction product obtained, also called leuco base or vat salt, is absorbed by the substrate and now can be reoxidized to the dyestuff. Vat dyestuffs therefore contain structural elements which, in the oxidized form, make the molecule insoluble in water and, in the reduced form, which can be obtained reversibly, make it soluble in water.

Up to now, the removal of these vat dyestuffs from denim pieces by the employment of hypochlorite or bleaching lye was customary. Based on the order by the Federal Ministry for Agriculture and Forestry regarding the Limitation of Waste Water Emissions from Textile Finishing and Processing Plants, Federal Law Gazette No. 612 of Sep. 24, 1992, it is required, for example in accordance with Sect. 33a of the Water Rights Law (WRG), to avoid hypochlorite. The free chlorine content of the waste water of these plants, calculated as $Cl_2$, is not permitted to exceed 0.2 mg/l, and absorbable, organically bound halogens (AOX), calculated as Cl, are not permitted to exceed 0.5 mg/l. In the course of the conventional production of stone-washed denim, considerable amounts of active chlorine remain in the bleaching bath. Organic molecules are created during chlorination of the vat dyes, which are removed along with the washing bath and are identified as AOX in the waste water.

The use of hypochlorite liquor furthermore has the disadvantage that some vat dyestuffs result in a blue with a greenish cast when the dyestuff molecule is chlorinated.

Customary methods used in textile dyeing cannot be employed for bleaching denim pieces. With dyeing, the aim is to obtain the most even coloration possible and an equal absorption of the dyestuff by the fibers. Up to now it was possible to make the vat dyestuffs water-soluble in the form of a leuco base by means of reducing agents and also mixtures of reducing agents. However, the dyestuff is simultaneous absorbed by the fibers. Sodium dithionite, hydroxymethane sulfinic acid, thiourea dioxide (formamidine sulfinic acid) or mixtures of these compounds are described as the usual reduction agents. Too strong reduction agents cannot be used, because it is possible that the dyestuff becomes over-reduced and destroyed (DE-A1-20 11 387). In accordance with DE-A1-38 22 194, alpha-hydroxycarbonyl compounds are also being considered in order to avoid over-reduction.

However, for bleaching denim pieces, the aim is to remove the dyestuff from the indigo-dyed warp and to prevent its absorption by the white shot (coloring). The shade is supposed to become lighter, but is not to be changed in depth. It is necessary to prevent AOX and active chlorine in the waste water.

It is therefore the object of the invention to avoid the above mentioned disadvantages, to produce evenly lightened denim pieces without coloring the white shot and changing the depth of shade. Chlorine and organic chlorine compounds in the waste water are to be prevented.

SUMMARY OF THE INVENTION

The method in accordance with the invention consists in that at increased temperatures the fabric is exposed to an aqueous bath containing a mixture of reducing agents, an alkali hydroxide and preferably a surface-active agent. The previously mentioned disadvantages, such as the formation of active chloride and absorbable organic halogens, the over-reduction of the dyestuffs and excessively high COD burdens of the waste water are prevented in this way.

The best known reducing agents used in vat dyeing of cellulose fibers are sodium dithionite, formamidine sulfinic acid (thiourea dioxide) and hydroxyacetone.

For example, it is known from DE-A1-20 11 387 to employ formamidine sulfinic acid in vat dyeing of textiles containing cellulose fibers. As is furthermore known from this patent, the reduction of the vat dyestuffs can additionally be performed in the presence of glucose in order to prevent the "over-reduction" of delicate dyestuffs. The evenness of the vat dyeing is described as needing improvement.

In DE-A1-38 33 194 the task of dyeing textile materials made of cellulose fibers with vat dyestuffs is performed in that combinations of the components A. Sodium dithionite and/or formamidine sulfinic acid and B. alpha-hydroxycarbonyl compounds at a weight ratio of 1:1 to 1:15 are used as reducing agent mixtures and dyeing is performed at pH values of at least 13 and at temperatures above 75° C.

It has now been surprisingly found that it is possible to perform bleaching of denim pieces with reducing agents. Bleaching of the denim pieces can take place, for example, at liquor ratios of 1:1 to 1:40, preferably 1:5 to 1:7.

In accordance with the invention, the removal of the dyestuffs takes place in an aqueous medium at pH values of 10 to 13, preferably at approximately 12.5, using reducing agents mixtures, and at temperatures above 50° C. Mixtures of formamidine sulfinic acid (thiourea dioxide) with carbohydrates of the general total formula $C_nH_{2n}O_n$ are considered as reducing agent mixtures. Suitable carbohydrates are, for example, monosaccharides, disaccharides, oligosaccharides and polysaccharides, for example glucose, sucrose, starch, molasses or pectin. It is of course also possible to use mixtures of several carbohydrates as the second component of the combination to be employed in accordance with the invention, for example mixtures of sucrose and glucose.

The weight ratio of formamidine sulfinic acid to the second component can advantageously be 80:20 to 99:1. The pH value is preferably adjusted by the addition of NaOH. Other bases, such as KOH, can also be employed.

After stone removal, the denim pieces are placed into fresh water and the temperature is increased to above 50° C. Starting at 75° C., a prepared solution consisting of formamidine sulfinic acid and the second component, a sodium hydroxide solution and auxiliary textile agents (dispersant, wetting agent) is metered into the washing machine. The vat dyestuffs are made soluble in the course of moving the liquor and the pieces and are removed from the fiber (indigo-dyed warp). The bleaching time is 1 to 30 minutes, preferably 15 minutes. The reducing agent mixtures are used in amounts of 0.5 to 10%, preferably 2 to 4%, depending on the desired lightness. Following this treatment the liquor is drawn off and the denim pieces are rinsed in water at 40° C. 2 g/l of conc. acetic acid and 1 g/l of hydrogen peroxide are added to the second rinse bath. Subsequently the denim pieces are tumbled and dried.

The method in accordance with the invention can of course also be performed in the presence of customary auxiliary textile agents, such as wetting agents, dispersing agents, tensides, etc.

The advantages of the method in accordance with the invention lie in that the denim pieces can be bleached in a highly reproducible manner. The dyestuff is reductively removed from the indigo-dyed warp. The concentration of the reducing agent, formamidine sulfinic acid, can be selected such that coloring of the white shot is prevented. In contrast to conventional dyeing, one portion of the fabric (warp) is decolorized in a controlled manner in accordance with the invention, without the other portion of the fabric (shot) being simultaneously colored. The waste water is free of chlorine and AOX. The waste water burden is clearly less than with the use of sodium hypochlorite. The vat dyestuff can be recovered from the waste water with small effort.

DESCRIPTION OF THE PREFERRED EMBODIMENTS

The following examples are intended to describe the invention without limiting it.

EXAMPLE 1

Formulation of the bleaching solution 5 l of water at 25° C. are placed into a container with a stirrer, and 60 g of caustic soda, 38 g of formamidine sulfinic acid and 2 g of sucrose are dissolved in it while stirring.

Execution of bleaching 4 kg of stone-washed denim pieces (blue jeans) and 20 l of water are heated to 75° C. After the temperature has been reached, the bleaching solution is added. The liquor is drained off after 15 minutes of agitation in the washing machine and the denim pieces are rinsed at approximately 40° C. 2 g/l of acetic acid and 1 g/l of a 35% hydrogen peroxide are added to the second rinse bath. The articles are subsequently tumbled and dried. The pH value of the liquor has been lowered from 13 to 12.3. A whiteness (filter R 457) of 8.8 and a yellow value of −98.5 of the raw material was measured. The bleached denim pieces had an average whiteness of 19.4 (filter R 457) and a yellow value of −66.5. The warp was clearly lightened and the shot is pure white. The bleaching liquor has a COD value of 7280 mg of $O_2$/l and is free of absorbable organic halogens (AOX).

EXAMPLE 2

Formulation of the bleaching solution 720 g of a 50% sodium hydroxide solution and 228 g of formamidine sulfinic acid and 12 g of sucrose are dissolved in approximately 7 l of water while stirring.

Execution of bleaching 6 kg of stone-washed denim pieces and 30 l of water are heated to 80° C. The liquor is drained off following the addition of the bleaching solution and 15 minutes of agitation in the washing machine. The vat dyestuff is changed into the form insoluble in water by the addition of acid and hydrogen peroxide and is recovered from the liquor by filtration. The liquor has a light-yellow color and a COD value of 5000 mg of $O_2$/l. AOX cannot be detected. The denim pieces are washed, rinsed and dried as in Example 1.

The bleached denim pieces had a whiteness of 43.7 (raw material 8.8), measured by means of a whiteness-measuring device (filter R 457), and a yellow value of −24.0 (raw material −98.5).

This lightness is comparable with a bleached denim piece treated with sodium hypochlorite. By way of a comparison, the analysis of the waste water following bleaching with sodium hypochlorite resulted in a COD value of 18600 mg of $O_2$/l.

What is claimed is:

1. A method for bleaching textile material comprised at least in part of cellulose, comprising:

preparing a liquor comprising an aqueous alkaline solution of a bleaching agent comprised of formamidine sulfinic acid and at least one carbohydrate selected from the group consisting of monosaccharides, disaccharides, and oligosaccharides, the formamidine sulfinic acid and the at least one carbohydrate having a weight ratio of the formamidine sulfinic acid to the at least one carbohydrate which ranges from 80:20 to 99:1; and bleaching the textile material comprised at least in part of cellulose by contacting the textile material with the liquor at a temperature above 50° C.

2. The method according to claim 1, wherein the at least one carbohydrate comprises at least one monosaccharide which acts as a reducing agent.

3. The method according to claim 2, wherein the at least one monosaccharide is glucose.

4. The method according to claim 1, wherein the at least one carbohydrate comprises at least one oligosaccharide.

5. The method according to claim 4, wherein the at least one oligosaccharide is sucrose.

6. The method according to claim 1, wherein bleaching is performed at a liquor ratio ranging from 1:1 to 1:40.

7. The method according to claim 6, wherein bleaching is performed at a liquor ratio ranging from 1:5 to 1:7.

8. The method according to claim 1, wherein bleaching is conducted at a temperature of 75° C.

9. The method according to claim 1, wherein bleaching is conducted in an aqueous medium having a pH which ranges from 10 to 13.

10. The method according to claim 9, wherein bleaching is conducted in an aqueous medium having a pH of 12.5.

11. The method according to claim 1, wherein the textile material is denim.

12. A method for bleaching denim pieces, comprising:

preparing an aqueous alkaline solution comprised of water, a bleaching agent comprised of formamidine sulfinic acid and at least one carbohydrate selected from the group consisting of monosaccharides, disaccharides, and oligosaccharides, the formamidine sulfinic acid and the at least one carbohydrate having a weight ratio of the formamidine sulfinic acid to the at least one carbohydrate which ranges from 80:20 to 99:1, and an alkali hydroxide;

heating the denim pieces in water to a temperature above 50° C.;

bleaching the denim pieces by adding the aqueous alkaline solution to the denim pieces in water and agitating;

draining off the water having added aqueous alkaline solution; and drying the denim pieces.

13. The method according to claim 12, further comprising rinsing the denim pieces with water before drying.

14. The method according to claim 13, further comprising employing water heated to a temperature of about 40° C. in a first rinse, and adding acetic acid and hydrogen peroxide to water in a second rinse.

* * * * *